US005897940A

United States Patent [19]

Malhotra

[11] Patent Number: 5,897,940

[45] **Date of Patent: *Apr. 27, 1999**

[54] INK JET TRANSPARENCIES

[75] Inventor: Shadi L. Malhotra, Ontario, Canada

[73] Assignee: Xerox Corporation, Stamford, Conn.

[ * ] Notice: This patent is subject to a terminal disclaimer.

[21] Appl. No.: 08/657,218

[22] Filed: Jun. 3, 1996

[51] Int. Cl.[6] ..... B41M 5/00

[52] U.S. Cl. ..... 428/212; 428/195; 428/484

[58] Field of Search ..... 428/212, 213, 428/215, 323, 325–331, 412, 473.5, 489, 500, 532, 421, 422

[56] References Cited

U.S. PATENT DOCUMENTS 4,775,594 10/1988 Desjarlais ..... 428/421
4,956,225 9/1990 Malhotra ..... 428/216
4,997,697 3/1991 Malhotra ..... 428/195
5,320,902 6/1994 Malhotra et al. ..... 428/342

*Primary Examiner*—Pamela R. Schwartz
*Attorney, Agent, or Firm*—E. O. Palazzo

[57] ABSTRACT

A transparency comprised of a supporting substrate, and thereover and thereunder two coatings, a first heat dissipating and fire resistant coating layer in contact with the substrate, and wherein said first coating is comprised of a binder with a melting point in the range of from about 100° C. to about 275° C. and a heat dissipating fire retardant component; and in contact with each of said first layers a second ink receiving coating layer thereover comprising a blend of a binder polymer, a cationic component capable of complexing with ink composition dyes, a lightfastness inducing agent, a filler, a biocide, and an ink spreading fluoro compound containing from 1 to about 25 fluorines and wherein said fluoro compound possesses a melting point of between about 50° C. and about 100° C.

23 Claims, No Drawings

INK JET TRANSPARENCIES

BACKGROUND OF THE INVENTION

The present invention is directed to transparencies, and more specifically, to high projection efficiency, fire resistant, low haze, lightfast and waterfast ink jet transparencies with improved ink absorption and ink spreading when used in combination with liquid ink compositions and solid ink hot melt ink compositions such as those selected for ink jet printing processes, and thermal transfer printing. In embodiments of the present invention, the transparencies are comprised of a supporting substrate, such as paper, or MYLAR™, and thereover two coatings, a first coating layer which comprises a binder having a melting point in the range of from about 100° C. to about 275° C. and preferably from about 150° C. to 260° C., and a heat dissipating fire retardant compound, and a second dye immobilizing light resistant, water resistant ink receiving coating layer situated so that the first coating layer is between the second dye immobilizing, light resistant, water resistant ink receiving coating layer and the substrate, the second coating layer being comprised of a blend of a polymer, cationic monomeric or polymeric component capable of complexing with the dyes of the ink compositions, a lightfastness inducing agent, and or mixtures thereof, a filler, a biocide and an ink spreading agent of fluoro compounds, especially aliphatic and aromatic compounds containing from 1 to about 25 fluorine atoms, and having a melting point of between 50° C. to 100° C. and preferably wherein the two coatings, thus a total of four coatings, are present on each surface of the supporting substrate.

With the transparencies of the present invention, there are enabled a number of advantages, including the important advantages of high projection efficiency due primarily to improved flow of the liquid and solid hot melt inks on the ink receiving layers containing low surface energy fluoro compounds, and more specifically, in view of the low surface tension, about 30 to about 35 dynes/centimeter of the ink receiving layer. With the transparencies of the present invention, there are enabled a number of other advantages, including the important advantage of fire retarding characteristics for the transparencies when used in ink jet printers that employ heat or microwave energy for drying inks, low haze, that is, for example, wherein the transparencies permit greater than 95 percent of the light to be transmitted therethrough in embodiments, and which transparencies possess excellent lightfastness and waterfastness characteristics. The transparencies of the present invention can be selected for ink jet methods and apparatus, which employ hot melt wax based inks.

U.S. Pat. No. 4,801,473 and U.S. Pat. No. 4,877,676, the disclosures of each of which are totally incorporated herein by reference, disclose hot melt ink transparencies which include a transparent substrate of a polyester material, an ink pattern disposed on one surface of the transparent sheet in the form of three-dimensional ink spots having curved surfaces, and a transparent layer covering the ink spots which has an index of refraction approximately the same as that of the ink spots. The transparent layer is applied to the substrate and the ink spots in the form of a liquid coating which wets the surfaces of the substrate and ink spots and spreads over them to produce a transparent layer having a maximum deviation of about 20 degrees from a plane parallel to the substrate.

U.S. Pat. No. 4,775,594, the disclosure of which is totally incorporated herein by reference, discloses a polyester ink jet recording sheet for the production of a transparency obtained by coating the sheet with a clear layer including a nonvolatile organic acid selected from citric acid, glycolic acid, malonic acid, tartaric acid, maleic acid, fumaric acid, malic acid, and succinic acid. A coating composition for preparing the clear layer on the recording sheet is preferably comprised of, in addition to the organic acid, a water soluble resin selected from poly(vinylpyrrolidone), poly(acrylic acid), polyacrylamide, hydroxyethyl cellulose, carboxymethyl cellulose, and vinyl acetate-vinylpyrrolidone copolymer, a water insoluble resin selected from polyesters, poly(vinylbutyral)resin, polyketone resins, carboxylated resins, nitrocellulose polymers, styrenated acrylic polymers, allyl alcohol-styrene copolymers, and a fluorinated surfactant having the formula $R_f\ CH_2CH_2S\ CH_2CH_2\ N{+}(CH_3)_3CH_3SO_4{-}$ or $(R_f\ CH_2CH_2O)\ P(O)(ONH_4)_2$ or $(R_fCH_2CH_2O)_2P(O)(ONH_4)$ wherein $R_f{=}F(CF_2CF_2)_{3\text{-}8}$.

U.S. Pat. No. 4,956,225 discloses a transparency suitable for electrographic and xerographic imaging which comprises a polymeric substrate with a toner receptive coating on one surface thereof comprising blends selected from the group consisting of poly(ethylene oxide) and carboxymethyl cellulose; poly(ethylene oxide), carboxymethyl cellulose, and hydroxypropyl cellulose; poly(ethylene oxide) and vinylidene fluoride/hexafluoropropylene copolymer; poly (chloroprene) and poly(alpha-methylstyrene); poly (caprolactone) and poly(alpha-methylstyrene); poly(vinyl isobutyl ether) and poly(alpha-methylstyrene); poly (caprolactone) and poly(p-isopropyl alpha-methylstyrene); blends of poly(1,4-butylene adipate) and poly(alpha-methylstyrene); chlorinated poly(propylene) and poly (alpha-methylstyrene); chlorinated poly(ethylene) and poly (alpha-methylstyrene); and chlorinated rubber and poly (alpha-methylstyrene).

U.S. Pat. No. 4,997,697 discloses a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

U.S. Pat. No. 5,624,743, the disclosure of which is totally incorporated herein by reference, discloses a transparency comprised of a supporting substrate, thereover a first coating layer comprised of a binder having a glass transition temperature of less than about 55° C., a cellulosic viscosity modifier, a lightfastness inducing agent and a biocide; and a second ink-receiving coating layer comprised of a hydrophilic binder, an oxyalkylene containing compound, a dye mordant, an optional filler, and an optional biocide; and wherein the first coating is in contact with the substrate and is situated between the substrate and the second ink coating, and which transparency possesses a haze value of from about 1 to about 10 and a lightfastness value of from about 80 to about 95.

U.S. Ser. No. 5,672,424, the disclosure of which is totally incorporated herein by reference, discloses a transparency comprised of a supporting substrate, thereover a first coating layer comprised of an anionic layer that adheres well to the substrate; and a second cationic layer situated on the top of the first anionic layer that binds with the anionic layer and comprised of cationic quaternary monomers as well as polymers and a lightfastness inducing agent; and a third ink receiving layer situated on the top of the second cationic layer and comprised of block copolymers and graft polymers, a biocide and a filler; which transparency possesses a haze value of from about 0.5 to about 10 and a lightfastness value of from about 95 to about 98.

U.S. Ser. No. 5,683,793 the disclosure of which is totally incorporated herein by reference, discloses a transparency comprised of a supporting substrate, thereover a first coating layer comprised of an ink absorbing layer and a biocide; and a second inkspreading coating layer comprised of a hydrophilic vinyl binder, a dye mordant, a filler, an optional lightfastness inducing agent and an ink spot size increasing agent selected from the group consisting of hydroxy acids, amino acids and polycarboxyl acids; and wherein the first coating is in contact with the substrate and is situated between the substrate and the second ink coating, and which transparency possesses a haze value of from about 0.5 to about 10 and a lightfastness value of from about 95 to about 98.

The disclosures of each of the patents and applications recited herein are totally incorporated herein by reference in their entirety.

While the above transparencies are suitable for their intended purposes, a need remains for improved high projection efficiency such as a projection efficiency greater than 90 percent. In addition, a need remains for fire resistant transparencies particularly suitable for use in ink jet and electrophotographic applications that employ heat and microwave energy to fix inks and toners. In addition, a need remains for transparencies that can be used in printers that employ solid hot melt inks. In addition, a need remains for transparencies with excellent low haze characteristics, such as haze value of between from about 0.5 to about 10 and preferably between 0.5 to 5, a feature not easily obtained considering that the total thickness of the two layered coatings can range from about 2 to about 50 microns and average about 25 microns. There is also a need for improved waterfastness and excellent lightfastness in the range of from about 80 to about 98 percent, and a need for transparencies wherein colors can be satisfactorily projected. A need also remains for transparencies which are particularly suitable for use in printing processes wherein the recorded transparencies are imaged with liquid and solid inks and dried by exposure to radiant heat or microwave radiation. Further, there is a need for transparencies coated with a discontinuous, porous film. There is also a need for transparencies which, subsequent to being imaged with an aqueous liquid or solid ink, exhibit reduced curling. These and other needs are achievable with the transparencies of the present invention in embodiments thereof.

SUMMARY OF THE INVENTION

It is an object of the present invention to provide transparencies with many of the advantages illustrated herein.

It is an object of the present invention to provide transparencies with high projection efficiency such as projection efficiency in the range of from between about 90 to about 95 percent.

It is another object of the present invention to provide fire resistant transparencies particularly suitable for use in electrophotographic and ink jet applications that employ heat and microwave energy to fix inks and toners.

It is another object of the present invention to provide transparencies particularly suitable for ink jet printers employing solid hot melt wax colored inks.

It is another object of the present invention to provide transparencies with waterfast and lightfast images.

It is yet another object of the present invention to provide transparencies with low haze characteristics, such as from about 0.5 to about 10, and wherein the color gamut is acceptable and does not substantially change.

Moreover, another object of the present invention is to provide transparencies with the combination of excellent lightfastness properties, such as from about 90 to about 98, and low haze characteristics, such as from about 0.5 to about 10 and preferably from about 0.5 to about 5, wherein the color gamut is acceptable and does not substantially change.

These and other objects of the present invention can be accomplished in embodiments thereof by providing transparencies with coatings thereover. More specifically, the transparencies of the present invention are comprised of a supporting substrate, and thereover two coatings, a first coating layer which comprises a binder and a heat dissipating and fire retardant compound, a second dye immobilizing light resistant, water resistant ink receiving coating layer situated so that the first coating layer is between the second dye immobilizing, light resistant, water resistant ink receiving coating layer and the substrate, said second coating layer comprising a blend of a binder polymer, cationic component monomeric, such as tetrahexadecyl ammonium bromide (Fluka 87298), or polymer, such as polymethyl acrylate trimethyl ammonium chloride latex, HX42-1 available from Interpolymer Corporation, capable of complexing with the dyes present in the ink compositions a lightfastness inducing agent, and/or mixtures thereof, a filler, a biocide, and an ink spreading agent selected from the group consisting of fluoro compounds containing from 1 to about 25 fluoro groups and having a melting point of between 50° C. to 100° C. such as a fluoro acid like perfluoroadipic acid hydrate, (Aldrich #26,883-6); fluoroalkyl such as 1,1,1,2,2,3,3,4,4,5,5,6,6,7,7,8,8-heptadecafluoro-10-iodo decane (Aldrich #37,052-5); fluoro aryl such as octafluoro naphthalene (Aldrich #24,806-1), and 4,4'-dimethoxy octafluorobiphenyl (Aldrich #10,221-0); and preferably wherein the two coatings are present on each surface of the supporting substrate.

Embodiments of the present invention include a transparency comprised of a supporting substrate, and thereover two coatings, a first heat dissipating and fire resistant coating layer in contact with the substrate, and wherein said first coating is comprised of a binder with a melting point in the range of from about 100° C. to about 275° C. and a heat dissipating fire retardant component, and a second ink receiving coating layer thereover comprising a blend of a binder polymer, a cationic component, a lightfastness inducing agent, a filler, a biocide, and an ink spreading fluoro compound containing from 1 to about 25 fluorine atoms and having a melting point of between about 50° C. to about 100° C.; a transparency comprised of a supporting substrate, thereover and thereunder a first coating layer which dissipates heat and is substantially fire resistant, and which first coating is comprised of a binder with a melting point in the range of from about 100° C. to about275° C. and a heat dissipating fire retardant component, and wherein said binder is present in amounts of from about 5 parts by weight to about 95 parts by weight and said fire retardant component is present in amounts of from about 95 parts by weight to about 5 parts by weight; and a second ink receiving coating layer situated on the top of the first heat dissipating and fire resistant layer, and which second coating is comprised of a blend of a binder polymer, an ink spreading fluoro compound, a cationic component, a lightfastness inducing agent, a filler and a biocide, and which transparency possesses a haze value of from about 0.5 to about 5, projection efficiency of between 90 to 95 percent, a lightfastness value of between 90 to 98 percent, and a transparency comprised of a supporting substrate, and thereover and thereunder two coatings, a first heat dissipating and fire resistant coating layer in contact with the substrate, and wherein said first coating is comprised of a binder with a melting point in the range of from about 100° C. to about275° C. and a heat dissipating fire retardant component, and a second, ink receiving coating layer thereover comprising a blend of a binder polymer, a cationic component capable of complexing with ink composition dyes, a lightfastness inducing agent mixture, a filler, a biocide, and an ink spreading fluoro compounds containing from 1 to about 25 fluorines and with a melting point of between about 50° C. and about 100° C.

Examples of substrate materials include polyesters, including MYLAR™, polyethylene terephthalate available from E. I. DuPont de Nemours & Company, MELINEX™, polyethylene terephthalate available from Imperial Chemicals, Inc., CELANAR™, polyethylene terephthalate available from Celanese Corporation, polyethylene naphthalates, such as Kaladex PEN films available from Imperial Chemical Industries, polycarbonates, such as LEXAN™ available from General Electric Company, polysulfones, such as those available from Union Carbide Corporation, polyether sulfones, such as UDEL™ available from Union Carbide Corporation, cellulose triacetate, polyvinylchloride cellophane, polyvinyl fluoride, polyimides, and the like, with polyester, such as MYLAR™, being preferred primarily because of its availability and relatively low cost. The substrate can also be opaque, including opaque plastics, such as TESLIN™ available from PPG Industries, and filled polymers, available from ICI, with fillers such as oxides and sulfates.

The substrate, which preferably includes two coatings thereon, and two coatings thereunder in contact with the substrate, can be of any effective thickness. Typical thicknesses for the substrate are from about 50 to about 500 microns, and preferably from about 100 to about 125 microns, although the thickness may be outside these ranges.

The first layer coating composition, which comprises a blend of a binder having a melting point in the range of from about 100° C. to about 275° C. and preferably from about 150° C. to 260° C., include for example polycarbonate, vinyl chloride-vinylidene chloride copolymers, such as #058 available from Scientific Polymer Products, and a heat dissipating and fire retardant compound capable of dissipating excess energy, such as bromo chloro paraffin, available as DD-8207 from Dover Corporation, and which blend is present on the front side of the substrate of the multilayered transparency in various effective thicknesses. Typically, the total thickness of this first coating layer is from about 0.1 to about 25 microns and preferably from about 0.5 to 10 microns, although the thickness may be outside of these ranges. In the first coating composition, the binder or mixtures thereof can be present within the coating in any effective amount; typically, the binder or mixtures thereof are present in amounts of from about 5 parts by weight to about 95 parts by weight and the heat dissipating fire retardant compounds are present in amounts of from about 95 parts by weight to about 5 parts by weight. Preferably, binder or mixtures thereof are present in amounts of from about 50 parts by weight to about 95 parts by weight, and the heat dissipating fire retardant compounds are present from about 95 parts by weight to about 50 parts by weight.

The second layer ink receiving coating composition situated on the top of the first heat dissipating and fire retardant coating layer comprises a blend of a binder polymer, and a monomeric or polymeric cationic component capable of complexing with a dye, or the dyes present in an ink composition comprised, for example, of water and dye, a lightfastness mixture of a UV component, an antioxidant and an antiozonant, a filler, a biocide and an ink spreading agent comprised of fluoro compounds containing from 1 to about 25 fluoro, or fluorines and with a melting point of between 50° C. to 100° C., which layer is present on the top of the first heat dissipating fire retardant composition layer of the substrate of the multilayered transparency of the present invention in various effective thicknesses as, for example, illustrated herein. Typically, the total thickness of this second coating layer is from about 0.1 to about 25 microns and preferably from about 0.5 to about 10 microns, although the thickness can be outside of these ranges. In the second coating composition, or mixtures thereof, the binder components can be present within the coating in any effective amount; typically, the binder or mixtures thereof are present in amounts of from about 5 parts by weight to about 75 parts by weight and preferably from about 10 parts by weight to about 40 parts by weight, although the amounts can be outside of this range. The ink spreading fluoro compounds are, for example, present in the second layer coating composition in amounts of from about 60 parts by weight to about 5 parts by weight and preferably from about 40 parts by weight to about 4 parts by weight, although the amounts can be outside of this range. The cationic dye complexing components or mixture thereof are present in the second coating composition in amounts of from about 35 parts by weight to about 2 parts by weight and preferably from about 30 parts by weight to about 3 parts by weight, although the amounts can be outside of this range. The lightfastness inducing compounds or mixtures thereof are present in the second coating composition in amounts of from about 15 parts by weight to about 1 part by weight and preferably from about 15 parts by weight to about 2 parts by weight, although the amounts can be outside of this range. The fillers of the second layer coating composition are present in amounts of from about 1 part by weight to about 70 parts by weight and preferably from about 0.1 part by weight to about 50 parts by weight, although the amounts can be outside of this range. The biocides of the second layer coating composition are present in amounts of from about 5 parts by weight to about 0.1 part by weight and preferably from about 4.9 parts by weight to about 1 part by weight, although the amounts can be outside of this range.

The aforementioned amounts can be determined, for example, as follows:

Various blends of the binder, the ink spreading agent, cationic dye mordant components, lightfastness inducing agent, fillers, and the biocide were prepared in solvent, such as water, ethanol, tetrahydrofuran, and coated on to various substrates, such as polyester sheets, to yield coated transparencies with a single layer thereover and thereunder. After drying these polyester sheets at 100° C., they were tested for coating adhesion to paper or MYLAR™, and printed with a Xerox Corporation ink jet test fixture to, for example, check print quality, drying times of the images, lightfastness and intercolor bleed. The data was analyzed statistically for optimum range of compositions. A preferred composition range for the second layer coating of the transparency is the binder present in amounts of from about 10 parts by weight to about 40 parts by weight, the ink spreading fluoro compound present in an amount of from about 40 parts by weight to about 4 parts by weight, the cationic dye complexing component, present in an amount of from about 30 parts by weight to about 3 parts by weight, the lightfastness inducing agent, or mixtures thereof present in amounts of from about 15 parts by weight to about 2 parts by weight, the fillers present in amounts of from about 0.1 part by weight to about 50 parts by weight, and the biocide compounds, or mixtures thereof present in amounts of from about 4.9 parts by weight to about 1 part by weight; total 100 parts (10+40+30+15+0.1+4.9) to (40+4+3+2+50+1).

Embodiments of the present invention include a transparency comprised of a supporting substrate, and thereover two coatings, a first first heat dissipating fire retardant coating layer, which comprises a blend of a binder having a melting point of greater than 150° C., for example polycarbonates, such as #035 available from Scientific Polymer Products; vinyl chloride-vinylidene chloride copolymers, such as #058 available from Scientific Polymer Products; substituted cellulose esters cellulose acetate hydrogen phthalate, such as #085 available from Scientific Polymer Product;, hydroxypropylmethyl cellulose phthalate, such as HPMCP available from Shin-Etsu Chemical; hydroxypropyl methyl cellulose succinate, and a fire retardant material capable of dissipating energy, such as ethylene bis-tetrabromo phthalimide, available as Saytex BT-93 from Ethyl Corporation; bromo chloro paraffin, available as DD-8207 from Dover Corporation, poly[penta bromobenzyl]acrylate, available as FR-1025 from Dead Sea Bromine Corporation; brominated epoxy resin, available as Thermoguard 212 from M&T Corporation, and which blend is present on the front side of the substrate of the multilayered transparency of the present invention in any effective thickness. Typically, the total thickness of this first coating layer is from about 0.1 microns to about 25 microns and preferably from about 0.5 to 10 microns, although the thickness can be outside of these ranges. In the first coating composition, binder or mixtures thereof can be present within the coating in any effective amount; typically, the binder or mixtures thereof are present in amounts of from about 5 parts by weight to about 95 parts by weight and the heat dissipating fire retardant compounds are present from about 95 parts by weight to about 5 parts by weight. The second ink receiving coating layer can comprise a blend of (1) a binder polymer, such as hydroxypropyl cellulose (Klucel Type E available from Hercules Chemical Company), hydroxypropylmethyl cellulose phthalate, such as HPMCP available from Shin-Etsu Chemical, vinyl alcohol-vinyl acetate copolymers, such as #379 available from Scientific Polymer Products; (2) ink spreading fluoro compounds such as perfluoroadipic acid hydrate (Aldrich #26,883-6); nonadeca fluoro decanoic acid, (Aldrich #17,774-1); 1,1,1,2,2,3,3,4,4,5,5,6,6,7,7,8,8-heptadecafluoro-10-iodo decane, (Aldrich #37,052-5); heptadeca fluoro nonanoic acid, (Aldrich #39,445-9); decafluorobenzhydrol, (Aldrich #19,658-4); cationic component monomers, such as tetrahexadecyl ammonium bromide, (Fluka 87298), hexadecyl tributyl phosphonium bromide (Aldrich #27,620-0), stearyl tributyl phosphonium bromide (Aldrich #29,303-2), or polymers, such as polymethyl acrylate trimethyl ammonium chloride, such as HX42-1 available from Interpolymer Corporation, Mirapol AD-1, AZ-1available from Miranol, Incorporated, capable of complexing with the anionic dyes of the ink composition; a lightfastness inducing UV compound, such as poly[N,N-bis(2,2,6,6-tetramethyl-4-piperidinyl)-1,6-hexanediamine-co-2,4-dichloro-6-morpholino-1,3,5-triazine] (Cyasorb UV-3346, ™41,324-0, available from Aldrich Chemical Company), 2-dodecyl-N-(2,2,6,6-tetramethyl-4-piperidinyl) succinimide (Cyasorb UV-3581, #41,317-8, available from Aldrich Chemical Company), 2-dodecyl-N-(1,2,2,6,6-pentamethyl-4-piperidinyl) succinimide (Cyasorb UV-3604, #41,318-6, available from Aldrich Chemical Company), and preferably wherein the lightfastness inducing agent is comprised of a mixture or mixtures thereof; a lightfastness inducing antioxidant/antiozonant compound, such as didodecyl 3,3'-thiodipropionate, available as Cyanox, LTDP, #D12,840-6, from Aldrich Chemical Company, N,N'-bis(1,4-dimethyl pentyl)-ρ-phenylene diamine, available as Santoflex 13 from Monsanto Chemicals, and a filler, such as colloidal silica, and a biocide, such as a cationic poly (oxyethylene (dimethylamino)-ethylene (dimethylamino) ethylene dichloride) (Busan 77 available from Buckman Laboratories Inc.), and a cationic blend of methylene bisthiocyanate and dodecyl guanidine hydrochloride (available as Slime-Trol RX-31, RX-32, RX-32P, RX-33, from Betz Paper Chem Inc.).

One embodiment of the present invention includes a transparency with a first layer coating in a thickness of 10 microns, and comprised of 75 parts by weight of the polycarbonate, such as #035, having a melting point of 257° C. and available from Scientific Polymer Products, and 25 parts by weight of a heat dissipating and fire retardant compound ethylene bis-tetrabromo phthalimide, available as Saytex BT-93 from Ethyl Corporation, and a second 10 micron thick ink receiving layer comprised of a hydroxypropyl cellulose binder (Klucel Type E available from Hercules Chemical Company) present in amounts of 40 parts by weight, the ink spreading agent hepta deca fluoro nonanoic acid (Aldrich #39,445-9) present in an amount of 25 parts by weight, the cationic dye complexing component, polymethyl acrylate trimethyl ammonium chloride, such as HX42-1 available from Interpolymer Corporation, present in an amount of 25 parts by weight, a lightfastness mixture containing a UV compound, such as poly[N,N-bis(2,2,6,6-tetramethyl-4-piperidinyl)-1,6-hexanediamine-co-2,4-dichloro-6-morpholino-1,3,5-triazine](Cyasorb UV-3346, #41,324-0, available from Aldrich Chemical Company), present in amounts of 3 parts by weight, and which lightfastness mixture contains an antioxidant/antiozonant compound, such as didodecyl 3,3'-thiodipropionate, available as Cyanox, LTDP, #D12,840-6, from Aldrich Chemical Company and present in amounts of 2 parts by weight, the fillers colloidal silica present in amounts of 0.5 part by weight, and the biocide poly(oxyethylene (dimethylamino)-ethylene (dimethylamino) ethylene dichloride) (Busan 77 available from Buckman Laboratories Inc.) present in amounts of 4.5 parts by weight. This transparency has a haze value of 3, lightfast values of 95 percent, and waterfastness of 75 percent.

Examples of the first layer binder polymers in contact with both lateral surfaces of the substrate include hydrophobic polymers vinyl alcohol-vinyl acetate copolymers, such as #379 available from Scientific Polymer Products, vinyl chloride-vinyl acetate-vinyl alcohol terpolymers, such as #064, #427, #428 available from Scientific Polymer Products, vinyl chloride-vinylidene chloride copolymers, such as #058 available from Scientific Polymer Products, vinylidene chloride-acrylonitrile copolymers, such as #395, #396, available from Scientific Polymer Products; cellulose acetate hydrogen phthalate, such as #085 available from Scientific Polymer Products, hydroxypropylmethyl cellulose phthalate, such as HPMCP available from Shin-Etsu Chemical, hydroxypropyl methyl cellulose succinate, such as HPMCS available from Shin-Etsu Chemical, cellulose triacetate, such as #031 available from Scientific Polymer Products, cellulose acetate butyrate, such as #077 available from Scientific Polymer Products, styrene-allyl alcohol copolymers, such as #393, #394, available from Scientific Polymer Products, poly(methylmethacrylate), such as #037A available from Scientific Polymer Products, poly (phenyl methacrylate), such as #227 available from Scientific Polymer Products, or polycarbonates, such as #035 available from Scientific Polymer Products.

Examples of the first layer binder polymers in contact with both lateral surfaces of the substrate include hydrophilic polymers, such as polyester latex, such as Eastman AQ 29D available from Eastman Chemical Company, vinyl chloride latex, such as Geon 352 obtained from B. F. Goodrich Chemical Group, polystyrene latex, such as DL6622A, DL6688A, and DL6687A obtained from Dow Chemical Company, butadiene-acrylonitrile-styrene terpolymer latex, such as Tylac synthetic rubber latex 68-513 available from Reichhold Chemicals Inc., and mixtures thereof.

The first coating contains fire retardant compounds including (A) brominated polystyrene available as Pyrochek LM, Pyrochek 60 PB, Pyrochek 68PB, from Ferro Corporation; poly[penta bromobenzyl]acrylate available as FR-1025 from Dead Sea Bromine Corporation; brominated polyesters, brominated epoxy resin, available as Thermoguard 212 from M&T Corporation, brominated paraffin, available as DD-8126 from Dover Corporation, bromo chloro paraffin, available as DD-8207 from Dover Corporation, bromo chloro paraffin with phosphorus available as DD-8307, from Dover Corporation, chloro paraffin, available as Flexchlor 0002, Flexchlor 0008, Flexchlor 0023, available from Witco/Argus Corporation, condensed bromoacenaphthylene, available as Con-BACN from Tosoh Corporation, dibromoethyl dibromo cyclohexane, available as Saytex BCL-462 from Ethyl Corporation, dibromophenol available as Emery 9331 from Henkel/Emery Corporation, dibromo neopentyl glycol available as Emery 9336 from Henkel/Emery Corporation, 2,4,6-tribromophenol available as Emery 9332 from Henkel/Emery Corporation, tetrabromo bisphenol A, available as Emery 9350 from Henkel/Emery Corporation, tetrabromo bisphenol A di-2 hydroxyethyl ether, available as BA-50, BA-50P from Great Lakes Corporation, tetrabromo bisphenol A diacrylate, available as Sartomer 640 from Sartomer Corporation, tetrabromo xylene, available as Emery 9345 from Henkel/Emery Corporation, pentabromo toluene, available as Saytex -105 from Ethyl Corporation; bis[tribromophenoxy] ethane, available as FF-680 from Great Lakes Corporation, bis [pentabromo phenoxy] ethane, available as 77B from Ferro Corporation, pentabromo diphenyloxide, available as FR-1205 from Dead Sea Bromine Corporation, pentabromo diphenyloxide/aromatic phosphate, available as DE-60F from Great Lakes Corporation; octabromo diphenyloxide, available as FR-1208 from Dead Sea Bromine Corporation; decabromo diphenyloxide, available as FR-1210 from Dead Sea Bromine Corporation, hexabromo cyclododecane, available as Saytex -HBCD from Ethyl Corporation, tetradecabromo diphenoxy benzene, available as Saytex -120 from Ethyl Corporation; hexabromo cyclododecane tribromoallyl ether, available as FR-913 from Dead Sea Bromine Corporation; ethylene bis-tetrabromo phthalimide, available as Saytex BT-93, Saytex BT-93D, from Ethyl Corporation; ethylene bis dibromono bornane dicarboximide, available as Saytex BN-451 from Ethyl corporation; 1,2,3,4,7,8,9,10,13, 13,14,14-dodeca chloro-1,4:7,10-dimethanodibenzo (a,e) cyclooctene, available as Dechlorane plus 25, Dechlorane plus 515, Dechlorane plus 2520, from Occidental Corporation, pentabromo chloro cyclohexane, available as FR-651-A from Dow Chemicals; (B) ammonium phosphate, available as Amgard CHT, dimelamine phosphate, available as Amgard ND, melamine phosphate, available as Amgard NH, ammonium polyphosphate, available as Amgard Pl from Albright & Wilson Corporation, tributyl phosphate, available as Pliabrac TBP and tricresyl phosphate, available as Pliabrac TCP from Merrand Corporation, triphenyl phosphate, available as Disflamoll TP, trixylenyl phosphate, available as Disflamoll TXP, trichloroethyl phosphate, available as Disflamoll TCA from Mobay Corporation, tributoxyethyl phosphate, available as Kronitex, KP-140 from F.M.C. Corporation; diphenyl cresyl phosphate, available as Disflamoll DPK, diphenyl octyl phosphate, available as Disflamoll DPO from Mobay Corporation, brominated triaryl phosphate, available as Kronitex PB-460 from F.M.C. Corporation, fatty alcohol polyglycol phosphate, available as Rewophat TD 70 from Rewo GmbH Corporation, tetrakis (2-chloroethyl) ethylene phosphate, available as Thermolin 101 from Olin Corporation; (C) inorganic compounds such as magnesium carbonate, available as Elastocarb Tech Light, Elastocarb Tech High from Morton International Corporation, magnesium hydroxide, available as Versamag B-16, Versamag DC, Versamag SB, Versamag UF, from Morton International Corporation, antimony oxide, available as Harshaw-HFR-201 from M&T Harshaw Corporation, zinc borate, available as Firebrake ZB from U.S. Borax Corporation, alumina trihydrate, available as Haltex 300 from Hitox Corporation, semicalcined silica-alumina available as sillum-200, sillum-200Q/P, sillum PL-200, all from D.J. Enterprises, silicone fluid SFR-100, available from G.E. Corporation; and mixtures thereof.

Examples of the second ink receiving layer situated on the top of the first heat and fire retardant layer in contact with the substrate include binders such as water soluble polymers, such as (a) hydrophilic polysaccharides and their modifications, such as (1) alkyl celluloses, such as methyl cellulose (Methocel AM 4 available from Dow Chemical Company), (2) hydroxy alkyl celluloses, such as hydroxyethyl cellulose (Natrosol 250 LR available from Hercules Chemical Company), and hydroxypropyl cellulose (Klucel Type E available from Hercules Chemical Company), (3) alkyl hydroxy alkyl celluloses, such as ethyl hydroxyethyl cellulose (Bermocoll available from Berol Kem. A. B. Sweden), (4) hydroxy alkyl alkyl celluloses, such as hydroxyethyl methyl cellulose (HEM available from British Celanese Ltd., also available as Tylose MH, MHK from Kalle A. G.), hydroxypropyl methyl cellulose (Methocel K35LV available from Dow Chemical Company), and hydroxy butylmethyl cellulose (such as HBMC available from Dow Chemical Company), (5) dialkylammonium halide hydroxy alkyl cellulose, such as diethylammonium chloride hydroxy ethyl cellulose, available as Celquat H-100, L-200 from National Starch and Chemical Company, (6) hydroxyalkyl trialkyl ammonium halide hydroxyalkyl cellulose, such as hydroxypropyl trimethyl ammonium chloride hydroxyethyl cellulose, available from Union Carbide Company as Polymer JR, (7) carboxy alkyl cellulose salts, such as sodium carboxymethyl cellulose CMC 7HOF available from Hercules Chemical Company, (8) cellulose sulfate salts, such as sodium cellulose sulfate #023 available from Scientific Polymer Products, (9) carboxyalkylhydroxyalkyl cellulose salts, such as sodium carboxymethylhydroxyethyl cellulose CMHEC 43H and 37L available from Hercules Chemical Company; (10) poly(vinyl alcohol), such as Elvanol available from DuPont Chemical Company, (11) poly(vinyl pyrrolidone) such as those PVP K-15, PVP K-30, PVP K-60, PVP K-90 available from GAF Corporation, (12) poly(vinyl alcohol) alkoxylated, (13) polyester latex, such as Eastman AQ 29D available from Eastman Chemical Company, (14) acrylic-vinyl acetate copolymer emulsions, such as Rhoplex AR-74 from Rohm and Haas Company, (15) vinyl acrylic terpolymer latex, such as 76 RES 3103 from Union Oil Chemical Division, (16) acrylic emulsion latex, such as Rhoplex B-15J, Rhoplex P-376, from Rohm and Haas Company, (17) poly(acrylamide), such as #02806 available from Poly Sciences Inc., (18) acrylamide-acrylic acid copolymers, such as #04652, #02220, and #18545 available from Poly Sciences Inc., (19) poly(N,N-dimethyl acrylamide), such as #004590 available from Poly Sciences Inc., and (20) poly(ethylene oxide), such as POLY OX WSRN-3000 available from Union Carbide Corporation.

Examples of the second ink receiving layer situated on the top of the first heat and fire retardant layer in contact with the substrate include also as binders solvent soluble polymers, such as (1) vinyl alcohol-vinyl butyral copolymers, such as #381 available from Scientific Polymer Products, (2) vinyl alcohol-vinyl acetate copolymers, such as #379 available from Scientific Polymer Products, (3) cellulose acetate hydrogen phthalate, such as #085 available from Scientific Polymer Products, (4) hydroxypropylmethyl cellulose phthalate, such as HPMCP available from Shin-Etsu Chemical, (5) hydroxypropyl methyl cellulose succinate, such as HPMCS available from Shin-Etsu Chemical.

Examples of the ink spreading agents of the second ink receiving layer include fluoro compounds, such as perfluoroadipic acid hydrate (Aldrich #26,883-6); nona deca fluoro decanoic acid (Aldrich #17,774-1); 1,1,1,2,2,3,3,4,4,5,5,6,6,7,7,8,8-heptadecafluoro-10-iodo decane (Aldrich #37,052-5); hepta deca fluoro nonanoic acid (Aldrich #39,445-9); bis(trifluoromethyl)2,3,4,5,6-pentafluorobenzamide (Aldrich #10,375-6); decafluorobenzhydrol (Aldrich#19,658-4); decafluoro benzo phenone (Aldrich #10,189-3); decafluorobiphenyl (Aldrich #D22-7); 2,2',3,3',5,5',6,6'-octafluoro biphenyl (Aldrich #19,663-0) 2,2,3,3,4,4,5,5-octafluoro-1,6-hexanediol (Aldrich #40,642-2); octafluoro naphthalene (Aldrich #24,806-1); 4,4'-dimethoxy octafluorobiphenyl (Aldrich #10,221-0); α, α, α, 2,3,5,6-heptafluoro-ρ-tolyl hydrazine(Aldrich #30,713-0); 2,5-bis (trifluoromethyl) benzoic acid (Aldrich #32,527-9); 3,5-bis (trifluoromethyl)pyrazole (Aldrich #39,039-9); 2,8-bis (trifluoromethyl)-4-quinolinecarbonitrile (Aldrich #33,842-7); hexafluoro glutaric acid (Aldrich #19,690-8); 3,3'-(hexafluoroisopropylidene)dianiline (Aldrich #40,712-7); 4,4'-(hexafluoroisopropylidene)ditoluene (Aldrich #36,768-0); 3,5-bis(trifluoromethyl)benzyl alcohol (Aldrich #26,337-0); 4-bromo-2,8-bis(trifluoromethyl)quinoline (Aldrich #34,609-8); 2,3,4,5,6-pentafluorobenzhydrol (Aldrich #28,230-8); 2,3,4,5,6-pentafluoro-α-(nitromethyl)-benzyl alcohol (Aldrich #34,910-0); pentafluoro phenyl hydrazine (Aldrich #15,638-8); 2,3,4,5-tetrafluorobenzoic acid (Aldrich #32,626-7); 1-(2,3,5,6-tetrafluorophenyl) imidazole (Aldrich #37,681-7); 2,3,5,6-tetrafluorophenyl hydrazine (Aldrich #19,679-7); tetrafluoro phthalonitrile (Aldrich #19,681-9); 2,3,5,6-tetrafluoro-4-pyridine carbonitrile (Aldrich #34,459-1); tetrafluororesorcinol hydrate (Aldrich #39,725-3); 1-bromo-4-chloro-2,3,5,6-tetrafluorobenzene (Aldrich #30,426-3); 1,4-dibromotetra fluorobenzene (Aldrich #D4,385-9, Aldrich #10,016-1); 4-bromo-2,3,5,6-tetrafluoro aniline (Aldrich #30,363-1); 4-amino-2,3,5,6-tetrafluoropyridine (Aldrich #30,062-4); (2,2,2-trifluoroacetamide (Aldrich #14,465-7); 2,4,5-trifluoro aniline (Aldrich #31,108-1); 2-(trifluoromethyl) benzophenone (Aldrich #23,312-9); 4,4,4-trifluoro-1-(2-naphthyl)-1,3-butanedione Aldrich #34,363-3); 2-chloro-5(trifluoro methyl)benzoic acid (Aldrich #37,683-3); 4-chloro-7-(trifluoromethyl)quinoline (Aldrich #18,602-3); 4-chloro-8-(trifluoromethyl) quinoline (Aldrich #38,226-4); ethyl(R)-(+)-2-{4-[trifluoromethyl) phenoxy] phenoxy}propionate (Aldrich #25,074-0), β-nitro-4-(trifluoromethoxy)styrene (Aldrich #41,133-7); trans-β-nitro-2-(trifluoromethyl)styrene (Aldrich #41,184-1); trans-β-nitro-3-(trifluoromethyl)styrene (Aldrich #41,085-3); 4-nitro-3-(trifluoromethyl)phenol (Aldrich #N2,780-2); 2-chloro-3,5-dinitro benzotrifluoride (Aldrich #24,799-5); 4-chloro-3,5-dinitrobenzotrifluoride (Aldrich #19,701-7); 2-amino-3-chloro-5-(trifluoromethyl)pyridine (Aldrich #36,608-0); 2,2,2-trifluoro-2',4,'6'-trimethoxyacetophenone (Aldrich #42,418-8); 2,3,4-trifluoro-6-nitroaniline (Aldrich #42,362-8); 3,3,3-trifluoro-1-phenyl-1,2-propanedione hydrate (Aldrich #41,421-2); 3,3'-difluorobenzophenone (Aldrich #32,717-4); 4,4'-difluoro biphenyl (Aldrich #D10,240-7); 3,5-difluoro phenylacetic acid (Aldrich #29,044-0); 2,5-difluorophenylhydrazine (Aldrich #32,419-1); 2-chloro-2,2-difluoroacetamide, (Aldrich #37,528-4); 3-chloro-2,4-difluoroaniline (Aldrich #37,796-6); 2-chloro-3,5-difluoroanisole (Aldrich#37,529-2); 2'-fluoroacetanalide (Aldrich #29,973-1); 3'-fluoroacetanalide (Aldrich #36,378-2); 2-fluoro biphenyl (Aldrich #10,274-1); 3-fluorocatechol (Aldrich #34,465-6); 5'-fluoro-2'-hydroxyacetophenone (Aldrich #24,717-0); 4-fluorophenyl methyl sulfone (Aldrich #18,433-0); 4-bromo-2fluoro-6-nitroanisole (Aldrich #33,967-9); 2-chloro-4-fluorobenzaldehyde (Aldrich #34,807-4); 2-chloro-4-fluorobenzonitrile (Aldrich #34,426-5); 2-chloro-6-fluorobenzo nitrile (Aldrich #18,818-2); 3-chloro-4fluorobenzonitrile (Aldrich #37,658-2); 2-chloro-4-fluoro-5-methylaniline (Aldrich #36,240-9); 2,4-dibromo-6-fluoroaniline (Aldrich #34,071-5); 2,6-dibromo-4-fluoroaniline (Aldrich #34,072-3); and 2,6-dibromo-4-fluorophenol(Aldrich #26,003-7).

Further, as illustrated herein the second layer coating of the transparencies of the present invention contains lightfastness compositions preferably comprised of two components, such as a UV absorbing compound and an anti oxidant compound, and in embodiments three components, such as a UV absorbing compound, an antioxidant compound, and an antiozonant compound.

The UV absorbing lightfastness compounds of the second layer coating of the transparencies of the present invention include octyl dimethyl amino benzoate, available as Escalol 507 from Van Dyk Corporation; hexadecyl 3,5-di-tert-butyl-4-hydroxy-benzoate, available as Cyasorb UV-2908, #41,320-8, from Aldrich Chemical Company; octyl salicylate, available as Escalol 106 from Van Dyk Corporation; octyl methoxy cinnamate, available as Parasol MCX from Givaudan Corporation; 2-hydroxy-4-methoxy benzophenone, available as Anti UVA from Acto Corporation; 2,2'-dihydroxy-4,4'-dimethoxy benzophenone, available as Uvinul D 49, #D11,100-7, from Aldrich Chemical Company; 2-hydroxy-4-(octyloxy)benzophenone, available as Cyasorb UV-531, #41,315-1, from Aldrich Chemical Company; 2-hydroxy-4-dodecyloxy benzophenone, available as DOBP from Eastman Chemicals; 2-(2'-hydroxy-5'methylphenyl)benzotriazole, available as Tinuvin 900 from Ciba Geigy Corporation; 2-[2'-hydroxy-3,5-di-(1,1-dimethyl benzyl)phenyl]-2H-benzotriazole, available as Topanex 100BT from ICI America Corporation; bis[2-hydroxy-5-tert-octyl-3-(benzotriazol-2-yl) phenyl methane, available as Mixxim BB/100 from Fairmount Corporation; 2-(4-benzoyl-3-hydroxyphenoxy)ethylacrylate (Cyasorb UV-416, #41,321-6, available from Aldrich Chemical Company), poly[2-(4-benzoyl-3-hydroxyphenoxy) ethylacrylate] (Cyasorb UV-2126, #41,323-2, available from Aldrich Chemical Company), tris(3,5-di-tert-butyl-4-hydroxybenzyl) isocyanurate, available as Good-rite UV 3114 from Goodrich Chemicals; [2,2,6,6-tetramethyl-4-piperidinyl]-1,2,3,4-butane tetra carboxylate, available as Mixxim HALS 57 from Fairmount Corporation; [2,2,6,6-tetramethyl-4piperidinyl/β,β,β',β'-tetramethyl-3,9-(2,4,8,10-tetraoxospiro (5,5) undecane)diethyl]-1,2,3,4-butane tetracarboxylate, available as Mixxim HALS 68 from Fairmount Corporation; [1,2,2,6,6-pentamethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 63 from Fairmount Corporation; 2-dodecyl-N-(2,2,6,6-tetramethyl-4-piperidinyl) succinimide, available as Cyasorb UV-3581, #41,317-8, from Aldrich Chemical Company; 2-dodecyl-N-(1,2,2,6,6-pentamethyl-4-piperidinyl) succinimide, available as Cyasorb UV-3604, #41,318-6, from Aldrich Chemical Company; N-(1-acetyl-2,2,6,6-tetramethyl-4-piperidinyl)2-dodecyl succinimide, available as Cyasorb UV-3668, #41,319-4, from Aldrich Chemical Company; tetrasodium N-(1,2-dicarboxyethyl)-N-octadecyl sulfosuccinamate, available as Aerosol 22N from American Cyanamid Corporation; nickel dibutyldithiocarbamate, available as UV-Chek AM-105 from Ferro Corporation; poly(3,5-di-tert-butyl-4-hydroxyhydro cinnamic acid ester)/1,3,5-tris(2-hydroxyethyl)-5-triazine-2,4,6(1H,3H, 5H)-trione, available as Good-rite 3125 from Goodrich Chemicals; poly[N,N-bis (2,2,6,6-tetramethyl-4-piperidinyl)-1,6hexanediamine-co-2,4-dichloro-6-morpholino-1,3,5-triazine], available as Cyasorb UV-3346, #41,324-0, from Aldrich Chemical Company, or 1-[N[poly(3-allyloxy-2-hydroxypropyl)-2-aminoethyl]-2-imidazolidinone, #41,026-8, available from Aldrich Chemical Company.

The antioxidant lightfastness components of the second layer coating of the transparencies of the present invention include didodecyl 3,3'-thiodipropionate, available as Cyanox, LTDP, #D12,840-6, from Aldrich Chemical Company; ditridecyl 3,3'-thiodipropionate, available as Cyanox 711, #41,311-9, from Aldrich Chemical Company; ditetradecyl 3,3'thiodipropionate, available as Cyanox MTDP, #41,312-7, from Aldrich Chemical Company; dicetyl 3,3'-thiodipropionate, available as Evanstab 16 from Evans Chemetics Corporation; dioctadecyl 3,3'-thiodipropionate, available as Cyanox STDP, #41,310-0, from Aldrich Chemical Company; triethyleneglycol bis[3-(3'-tert-butyl-4'-hydroxy-5'-methylphenyl) propionate], available as Irganox 245 from Ciba-Geigy Corporation; octadecyl 3-(3,5-di-tert-butyl-4-hydroxyphenyl)propionate, available as Ultranox 276 from General Electric Company; 1,6-hexamethylene bis(3,5-di-tert-butyl-4-hydroxy hydrocinnamate), available as Irganox 259 from Ciba-Geigy Corporation; tetrakis [methylene(3,5-di-tert-butyl-4-hydroxy hydrocinnamate)], available as Irganox 1010 from Ciba-Geigy Corporation; thiodiethylenebis(3,5-di-tert-butyl-4-hydroxy) hydrocinnamate, available as Irganox 1035 from Ciba-Geigy Corporation; octadecyl 3,5-di-tert-butyl-4-hydroxy hydrocinnamate, available as Irganox 1076 from Ciba-Geigy Corporation; N,N'-hexamethylene bis(3,5-di-tert-butyl-4-hydroxy hydrocinnamide), available as Irganox 1098 from Ciba-Geigy Corporation; 2,2-bis[4-(2-(3,5-di-tert-butyl-4-hydroxyhydrocinnamoyloxy))ethoxy phenyl] propane, available as Topanol 205 from ICI America Corporation; N-stearoyl-ρ-aminophenol, available as Sucnox-18 from Hexcel Corporation; 2,6-di-tert-butyl-4-methyl phenol, available as Ultranox 226 from General Electric Company; 2,6-di-tert-butyl-ρ-cresol, available as Vulkanox KB from Mobay Chemicals; 2,6-di-tert-butyl-α-dimethylamino-ρ-cresol, available as Ethanox 703 from Ethyl Corporation; 2,2'-isobutylidenebis(4,6-dimethyl phenol), available as Vulkanox NKF from Mobay Chemicals; 2,2'-methylene bis(6-tert-butyl-4-methylphenol), available as Cyanox 2246, #41,315-5, from Aldrich Chemical Company; 2,2'-methylene bis(6-tert-butyl-4-ethylphenol), available as Cyanox 425, #41,314-3, from Aldrich Chemical Company; tris(4-tert-butyl-3-hydroxy-2,6-dimethylbenzyl) isocyanurate, available as Cyanox 1790, #41,322-4, LTDP, #D12,840-6, from Aldrich Chemical Company; 1,3,5-trimethyl-2,4,6-tris(3,5-di-tert-butyl-4-hydroxybenzyl) benzene, available as Ethanox 300, #41,328-3, from Aldrich Chemical Company; triphenyl phosphite, available as Lankromark LE65 from Harcros Corporation; tris(nonyl phenyl) phosphite, available as Lankromark LE109 from Harcros Corporation; tris(2,4-di-tert-butylphenyl)phosphite, available as Wytox 240 from Olin Corporation; 2,2'-ethylidene bis(4,6-di-tert-butylphenyl) fluorophosphonite, available as Ethanox 398 from Ethyl Corporation; octylated diphenylamine, available as Anchor ODPA from Anchor Corporation; N,N'-β,β'-naphthalene-ρ-phenylenediamine, available as Anchor DNPD from Anchor Corporation; 4,4'-methylene-bis(dibutyldithio carbamate), available as Vanlube 7723 from Vanderbilt Corporation; antimony dialkyldithio carbamate, available as Vanlube 73 from Vanderbilt Corporation; antimony dialkylphosphorodithioate, available as Vanlube 622, from Vanderbilt Corporation; molybdenum oxysulfide dithio carbamate, available as Vanlube 622 from Vanderbilt Corporation; 2,2,4-trimethyl-1,2-hydroquinoline, available as Vulkanox HS from Mobay Corporation; and mixtures thereof.

The antiozonant lightfastness components of the second layer coating of the transparencies of the present invention include N-isopropyl-N'-phenyl-phenylene diamine, available as Santoflex IP from Monsanto Chemicals; N-(1,3-dimethylbutyl)-N'-phenyl-phenylene diamine, available as Santoflex 13 from Monsanto Chemicals; N,N'-di(2-octyl)-ρ-phenylene diamine, available as Antozite-1 from Vanderbilt Corporation; N,N'-bis (1,4-dimethyl pentyl)-ρ-phenylene diamine, available as Santoflex 77 from Monsanto Chemicals; 2,4,6-tris-(N-1,4-dimethyl pentyl-ρ-phenylene diamino)-1,3,5-triazine, available as Durazone 37 from Uniroyal Corporation; 6-ethoxy-1,2-dihydro-2,2,4-trimethyl quinoline, available as Santoflex AW from Monsanto Chemicals; and bis-(1,2,3,6-tetrahydrobenzaldehyde) pentaerythritol acetal, available as Vulkazon AFS/LG from Mobay Corporation; paraffin wax, available as Petrolite C-700 Petrolite C-1035, from Petrolite Corporation; and mixtures thereof. Thus, in embodiments the lightfastness component is comprised of a mixture of an antioxidant, a UV component, and an antiozonant, and wherein in embodiments the antioxidant can function as both an antioxidant and a antiozonant.

The second layer ink receiving coating of the present invention contains, as illustrated herein, dye immobilizing cationic components, monomeric or polymeric, capable of complexing with the dyes used in the ink composition. Examples of suitable dye immobilizing cationic components, monomeric or polymeric, capable of complexing with the dyes used in the ink compositions include quaternary ammonium block copolymers, such as Mirapol A-15 and MirapoL WT available from Miranol, Incorporated, Dayton, N.J., prepared as disclosed in U.S. Pat. No. 4,157,388, the disclosure of which is totally incorporated herein by reference, Mirapol AZ-1 available from Miranol, Inc., prepared as disclosed in U.S. Pat. No. 4,719,282, the disclosure of which is totally incorporated herein by reference, Mirapol AD-1 available from Miranol, Inc., prepared as disclosed in U.S. Pat. No. 4,157,388, Mirapol 9, Mirapol 95, and Mirapol 175 available from Miranol, Inc., Dayton, N.J., prepared as disclosed in U.S. Pat. No. 4,719,282, and the like. Other suitable cationic dye mordants comprise diamino alkanes, quaternary salts, and quaternary acrylic copolymer latexes.

Also suitable as dye immobilizing cationic components, monomeric or polymeric, capable of complexing with the dyes used in the ink compositions are fluoro compounds, such as tetra ammonium fluoride hydrate, 2,2,2-trifluoroethylamine hydrochloride (Aldrich #18,038-6); 2,2,2-trifluoroethyl-ρ-toluene sulfonate (Aldrich #17,782-2); 1-(α,α,α,-trifluoro-m-tolyl) piperazine hydrochloride, 4-bromo-α,α,α-trifluoro-o-toluidine hydrochloride, difluorophenylhydrazine hydrochloride, 4-fluorobenzylamine hydrochloride, 4-fluoro-α,α-dimethylphenethylamine hydrochloride, 2-fluoroethylaminehydrochloride, 2-fluoro-1-methyl pyridinium-ρ-toluene sulfonate, 4-fluorophenethylamine hydrochloride, fluorophenylhydrazine hydrochloride, 1-(2-fluorophenyl) piperazine monohydrochloride, 1-fluoro pyridinium trifluoromethane sulfonate 3,5-dichloro-1-fluoropyridinium triflate.

Further, suitable as dye immobilizing cationic components, monomeric or polymeric, capable of complexing with the dyes used in the ink compositions are monoammonium compounds as disclosed in, for example, U.S. Pat. No. 5,320,902, the disclosure of which is totally incorporated herein by reference, including (A) tetradecyl ammonium bromide (Fluka 87582), tetradodecyl ammonium bromide (Fluka 87249), tetrahexadecyl ammonium bromide (Fluka 87298), tetraoctadecyl ammonium bromide (Aldrich 35,873-8), and the like; (B) 2-coco trimethyl ammonium chloride (Arquad C-33, C-33W, C-50 from Akzo Chemie), palmityl trimethyl ammonium chloride (Adogen 444 from Sherex Chemicals), myristyl trimethyl ammonium bromide (Cetrimide BP Triple Crown America), benzyl tetradecyl dimethyl ammonium chloride (Arquad DM 14B-90 from Akzo Chemie), didecyl dimethyl ammonium bromide (Aldrich 29,801-8), dicetyl dimethyl ammonium chloride (Adogen 432CG, Sherex Chemicals), distearyl dimethyl ammonium methyl sulfate (Varisoft 137, 190-100P from Sherex Chemicals, Arosurf TA-100 from Sherex Chemicals), difatty acid isopropyl ester dimethyl ammonium methyl sulfate (Rewoquat CR 3099 from Rewo Quimica, Loraquat CR 3099 from Dutton and Reinisch), tallow dimethyl trimethyl propylene diammonium chloride (Tomah Q-D-T from Tomah), and N-cetyl, N-ethyl morpholinium ethosulfate (G-263 from ICI Americas).

Further, suitable as dye immobilizing cationic components, monomeric or polymeric, capable of complexing with the dyes used in the ink compositions are phosphonium compounds, such as, for example, those disclosed in U.S. Pat. No. 5,766,809, the disclosure of which is totally incorporated herein by reference, including bromomethyl triphenyl phosphonium bromide (Aldrich 26,915-8), [3-hydroxy-2-methyl propyl] triphenyl phosphonium bromide (Aldrich 32,507-4), 2-tetraphenyl phosphonium bromide (Aldrich 21,878-2), tetraphenyl phosphonium chloride (Aldrich 21879-0), hexadecyl tributyl phosphonium bromide (Aldrich 27,620-0), and stearyl tributyl phosphonium bromide (Aldrich 29,303-2).

Additional examples of materials suitable as dye immobilizing cationic components, monomeric or polymeric, capable of complexing with the dyes used in the ink compositions include those disclosed in U.S. Pat. No. 5,760,809 and U.S. Pat. No. 5,457,486, U.S. Pat. No. 5,314,747, U.S. Pat. No. 5,320,902, and U.S. Pat. No. 5,441,795, the disclosures of each of which are totally incorporated herein by reference.

Examples of the second ink receiving layer filler components include hollow microspheres, Eccospheres MC-37 (sodium borosilicate glass), Ucar BJO-0930 (phenolic polymers available from Union Carbide); and Miralite 177 (vinylidene chloride-acrylonitrile available from Pierce & Stevens Chemical Corporation); and the like. Examples of solid microspheres include Spheriglass E250P2and 10002A (soda-lime glass A-glass, E-glass), available from Potters Industries. Further information regarding microspheres is disclosed in, for example, *Encyclopedia of Polymer Science and Engineering*, vol. 9, p. 788 et seq., John Wiley and Sons (New York 1987), the disclosure of which is totally incorporated herein by reference, including sodium metasilicate anhydrous, available as Drymet 59 from Crossfield Chemicals, Incorporated, sodium metasilicate pentahydrate Crystamet 1020, Crystamet 2040, Crystamet 3080, from Crossfield Chemicals, Incorporated, magnesium oxide, available as Elastomag 100, Elastomag 100 R, Elastomag 170, Elastomag 170 micropellet; zirconium oxide (SF-EXTRA available from Z-Tech Corporation), colloidal silicas, such as Syloid 74 available from Grace Company, titanium dioxide (available as Rutile or Anatase from NL Chem Canada, Inc.), calcium carbonate (Microwhite Sylacauga Calcium Products), zinc oxide, such as Zoco Fax 183 available from Zo Chem, barium titanate, #20,810-8 available from Aldrich Chemicals, antimony oxide, #23,089-8 available from Aldrich Chemicals, and the like, as well as mixtures thereof.

Examples of suitable biocides of the second ink receiving layer include (A) nonionic biocides, such as 2-bromo-4'-hydroxyacetophenone (Busan 90 available from Buckman Laboratories); 3,5-dimethyl tetrahydro-2H-1, 3,5-thiadiazine-2-thione (Slime-Trol RX-28 available from Betz Paper Chem Inc.; a nonionic blend of 5-chloro-2-methyl-4-isothiazoline-3-one, 75 percent by weight, and 2-methyl-4-isothiazolin-3-one, 25 percent by weight (available as Amerstat 250 from Drew Industrial Division; Nalcon 7647 from Nalco Chemical Company; Kathon LX from Rohm and Haas Company); and the like, as well as mixtures thereof; (B) anionic biocides, such as anionic potassium N-hydroxymethyl-N-methyl-dithiocarbamate (available as Busan 40 from Buckman Laboratories Inc.); an anionic blend of methylene bis-thiocyanate, 33 percent by weight, sodium dimethyl-dithiocarbamate, 33 percent by weight, and sodium ethylene bisdithiocarbamate, 33 percent by weight, (available as Amerstat 282 from Drew Industrial Division; AMA-131 from Vinings Chemical Company); sodium dichlorophene (G-4-40 available from Givaudan Corporation); and the like, as well as mixtures thereof; (C) cationic biocides, such as cationic poly(oxyethylene (dimethylamino)ethylene (dimethylamino) ethylene dichloride) (Busan 77 available from Buckman Laboratories Inc.); a cationic blend of bis(trichloromethyl) sulfone and a quaternary ammonium chloride (available as Slime-Trol RX-36 DPB865 from Betz Paper Chem. Inc.); and the like, as well as mixtures thereof. The biocide can be present in any effective amount; typically, the biocide is present in an amount of from about 0.1 microns percent by weight to about 3 percent by weight of the coating, although the amount can be outside this range.

The coatings of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. Once the desired amount of coating has been applied to the web, the coating is dried, typically at from about 25° C. to about 100° C. in an air dryer.

The drying time of images obtained with the transparencies of the present application is the time for zero image offset and can be measured as follows: a line comprising different color sequences is drawn on the transparency with droplets of inks from an ink jet printhead moving from left to right and back. Thereafter, this image is purposely smeared with the pinch roll of the printer by fast forwarding the transparency mechanically while the pinch roll is on the top of the imaged line. This entire procedure takes about two seconds to complete. In the event that no offset of the printed image on the unprinted paper or transparency occurs, the drying time of the image is considered as less than two seconds.

Transparencies of the present invention in embodiments exhibit reduced curl upon being printed with aqueous inks, particularly in situations wherein the ink image is dried by exposure to microwave radiation. Generally, the term "curl" refers to the distance between the base line of the arc formed by the transparency or recording sheet when viewed in cross-section across its width (or shorter dimension, for example, 8.5 inches in an 8.5×11 inch sheet, as opposed to length, or longer dimension, for example, 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet) and the arc formed by the sheet can be matched against a pre-drawn standard template curve.

The transparencies of the present invention in embodiments exhibit little or no blocking. Blocking refers to the transfer of ink or toner from a printed image from one sheet to another when recording sheets are stacked together. The recording sheets of the present invention exhibit substantially no blocking under, for example, environmental conditions of from about 20 to about 80 percent relative humidity and at temperatures of about 80° F.

Further, the transparencies of the present invention in embodiments exhibit high resistance to humidity. Resistance to humidity generally is the capacity of a recording sheet to control the blooming and bleeding of printed images, wherein blooming represents intra-diffusion of dyes and bleeding represents inter-diffusion of dyes. The blooming test can be performed by printing a bold filled letter such as "T" on a recording sheet and placing the sheet in a constant environment chamber preset for humidity and temperature. The vertical and horizontal spread of the dye in the letter "T" is monitored periodically under a microscope. Resistance to humidity limit is established when the dyes selected begin to diffuse out of the letter "T". The bleeding test is performed by printing a checker board square pattern of various different colors and measuring the inter-diffusion of colors as a function of humidity and temperature.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

Haze values recited herein were measured by an XL-211 Hazegard Hazemeter supplied by Pacific Scientific Company.

The lightfastness values of the ink jet images were measured in the Mark V Lightfastness Tester obtained from Microscal Company, London, England.

Specific embodiments of the invention will now be described in detail. These Examples are intended to be illustrative, and the invention is not limited to the materials, conditions, or process parameters set forth in these embodiments. The coatings, a total of four are included on both surfaces or sides of the transparency unless otherwise indicated. All parts and percentages are by weight unless otherwise indicated.

EXAMPLE I

Twenty transparency sheets were prepared by the solvent extrusion process (single side each time initially) on a Faustel Coater using a one slot die by providing for each a MYLAR™ base sheet (roll form) with a thickness of 100 microns, and coating the front side of the base sheet with a hydrophobic heat dissipating/fire resistant coating comprised of 75 parts by weight of polycarbonate, #035, having a melting point of 257° C. and available from Scientific Polymer Products, and 25 parts by weight of the fire retardant compound poly[penta bromobenzyl]acrylate, available as FR-1025 from Dead Sea Bromine Corporation, which blend was present in a concentration of 5 percent by weight in dichloromethane. Subsequent to air drying at 100° C. and monitoring the difference in weight prior to and subsequent to coating, the dried MYLAR™ base sheet rolls contained 1.0 gram in a thickness of 10 microns of the hydrophobic heat and fire resistant coating. This hydrophobic heat dissipating/fire resistant coating was further overcoated on a Faustel Coater using a one slot die with a hydrophilic ink receiving layer comprised of a blend of 50 parts by weight of the binder hydroxypropyl cellulose (Klucel Type E available from Hercules Chemical Company), 20 parts by weight of ink spreading compound hepta deca fluoro nonanoic acid (Aldrich #39,445-9), and 24.9 parts by weight of a dye mordant capable of complexing with the dyes used in the ink composition, which mordant dye was polymethyl acrylate trimethyl ammonium chloride latex, HX42-1 available from Interpolymer Corporation, 3.0 parts by weight of UV absorbing compound poly[N,N-bis(2,2,6,6-tetramethyl-4-piperidinyl)-1,6-hexanediamine-co-2,4-dichloro-6-morpho lino-1,3,5-triazine] (Cyasorb UV-3346, #41,324-0, available from Aldrich Chemical Company), and 2.0 parts by weight of antioxidant/antiozonant didodecyl 3,3'-thiodipropionate and 0.1 microns part by weight of colloidal silica available as Syloid 74 from W. R. Grace and Company, which blend was present in a concentration of 10 percent by weight in tetrahydrofuran. Subsequent to air drying at 100° C. and monitoring the difference in weight prior to and subsequent to coating, the dried MYLAR™ base sheet rolls contained 1.0 gram in a thickness of 10 microns of the ink receiving layer. Rewinding the coated side of the MYLAR™ base sheet (roll form) on to an empty core and using these rolls, the uncoated back side of the MYLAR™ base sheet was coated on a Faustel Coater using a one slot die with the above hydrophobic heat dissipating/fire resistant coating blend which was further overcoated with the same above ink receiving layer as that on the front side. The transparency sheets thus prepared had a haze value of 4.5.

The above prepared transparencies were printed with a Xerox Corporation ink jet test fixture equipped with a microwave dryer and containing inks of the following compositions.

Cyan:

15.75 percent by weight of sulfolane, 12.0 percent by weight of butyl carbitol, 2.0 percent by weight of ammonium bromide, 13.0 percent by weight acetylethanolamine, 0.015 percent by weight of ammonium hydroxide, 0.05 percent by weight of polyethylene oxide (molecular weight 18,500) obtained from Union Carbide Company, 22.5 percent by weight of Projet Cyan 1 dye solution obtained from Zenca Colors, 18.75 percent by weight of Projet blue OAM dye solution obtained from Zenca Colors, and 15.935 percent by weight of deionized water.

Magenta:

15.75 percent by weight of sulfolane, 12.0 percent by weight of butyl carbitol, 2.0 percent by weight of ammonium bromide, 13.0 percent by weight of acetylethanolamine, 0.03 percent by weight of ammonium hydroxide, 0.05 percent by weight of DOWICIL 150 biocide obtained from Dow Chemical Company, Midland, Mich., 0.05 percent by weight of polyethylene oxide (molecular weight 18,500) obtained from Union Carbide Company, 25 percent by weight of Projet Magenta 1T dye solution obtained from Zenca Colors, 6.0 percent by weight of Acid Red 52 solution obtained from Tricon Colors, and 26.12 percent by weight of deionized water.

Yellow:

15.75 percent by weight of sulfolane, 12.0 percent by weight of butyl carbitol, 13.0 percent by weight of acetylethanolamine, 2.0 percent by weight of ammonium bromide, 0.03 percent by weight of ammonium hydroxide, 0.05 percent by weight of DOWICIL 150 biocide obtained from Dow Chemical Company, Midland, Mich., 0.05 percent by weight of polyethylene oxide (molecular weight 18,500) obtained from Union Carbide Company, 27.0 percent by weight of Projet Yellow 1G dye (7.5 percent solution) obtained from Zenca Colors, 20.0 percent by weight of Acid Yellow 17 solution obtained from Tricon Colors, and 10.12 percent by weight of deionized water.

Black:

20.0 percent by weight of sulfolane (Aldrich T2,220-9), 5.0 percent by weight of pantothenol (Aldrich 29,578-7), 5.0 percent by weight of 1,4-bis(2-hydroxyethoxy)-2-butyne (Aldrich B4,470-8), 5.0 percent by weight of 2,2'-sulfonyldiethanol (Aldrich 18,008-4), obtained from Aldrich Chemical Company, 0.05 percent by weight of DOWICIL 150 biocide obtained from Dow Chemical Company, Midland, Mich., 0.05 percent by weight of polyethylene oxide (molecular weight 18,500) obtained from Union Carbide Company, 7.0 percent by weight Carbon Black Levanyl A-SF (25.0 milliliters of predispersed Carbon Black Levanyl A-SF dispersion containing 28.0 percent solids of carbon black and 6.0 percent of dispersant), obtained from Bayer A.G of Germany, and 39.90 percent by weight of deionized water.

Images with 100 percent ink coverage were generated by printing block patterns for magenta, cyan, yellow, and black. These images were dried with a microwave dryer operated at 2.45 GHz frequency using serpentine wave guide mode for periods of one second and two seconds, by adjusting the dryer speed.

At a dryer speed of 4.33 inches per second (resident time of one second in the dryer), the resulting dried images yielded optical density values of 1.95 (black), 1.70 (cyan), 1.60 (magenta) and 0.9 (yellow). These images had lightfastness values greater than 90 percent and, more specifically, about 98 percent average for all colors after a period of six months, and showed no intercolor bleed when retained at a 80 percent humidity at 80° F. for a period of seven days. The projection efficiency of these images were measured at 92 percent.

At a dryer speed of 2.17 inches per second (resident time of two seconds in the dryer) the resulting overdried colored images suffered no image degradation due to the crystallization of dyes as observed by the absence of dark patches in the imaged colored areas during their projection on a 3M Model 905 Overhead Projector, and the black area printed with the carbon black pigmented ink did not melt away as the excessive heat generated by the absorption of microwave energy by the carbon black pigmented inks was dissipated over a wider area by the heat dissipating/fire resistant protective coating.

In a comparative study, Hewlett Packard Desk Jet Transparency 51636 F printed with a carbon black pigmented ink melted away as the excessive heat generated by the absorption of microwave energy by the carbon black pigmented inks was not dissipated evenly.

EXAMPLE II

Twenty transparency sheets were prepared by the solvent extrusion process (single side each time initially) on a Faustel Coater using a one slot die by providing for each a MYLAR™ base sheet (roll form) with a thickness of 100 microns, and coating the front side of the base sheet with a hydrophobic heat dissipating/fire resistant coating comprised of 75 parts by weight of hydroxypropylmethyl cellulose phthalate HPMCP available from Shin-Etsu Chemical, and 25 parts by weight of a fire retardant material ethylene bis-tetrabromo phthalimide, available as Saytex BT-93 from Ethyl Corporation, which blend was present in a concentration of 5 percent by weight in dichloromethane. Subsequent to air drying at 100° C. and monitoring the difference in weight prior to and subsequent to coating, the dried MYLAR™ base sheet rolls contained 1.0 gram in a thickness of 10 microns of the hydrophobic heat and fire resistant coating. This hydrophobic heat dissipating/fire resistant coating was further overcoated on a Faustel Coater using a one slot die with a hydrophilic ink receiving layer comprised of a blend of 50 parts by weight of vinyl alcohol-vinyl acetate copolymers, such as #379 available from Scientific Polymer Products, 20 parts by weight of perfluoroadipic acid hydrate (Aldrich #26,883-6), and 24.9 parts by weight of a dye mordant polymethyl acrylate trimethyl ammonium chloride latex, HX42-1 available from Interpolymer Corporation, 3.0 parts by weight of poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 2.0 parts by weight of didodecyl 3,3'-thiodipropionate, and 0.1 part by weight colloidal silica available as Syloid 74 from W. R. Grace and Company, which blend was present in a concentration of 10 percent by weight in tetrahydrofuran. Subsequent to air drying at 100° C. and monitoring the difference in weight prior to and subsequent to coating, the dried MYLAR™ base sheet rolls contained 1.0 gram in a thickness of 10 microns of the ink receiving layer. Rewinding the coated side of the MYLAR™ base sheet (roll form) on to an empty core and using these rolls, the uncoated back side of the MYLAR™ base sheet was coated first with the above hydrophobic heat dissipating/fire resistant coating that was present on the front side and was further overcoated with the same above hydrophilic ink receiving layer as that on the front side using a Faustel Coater with a one slot die. The transparency sheets thus prepared had a haze value of 3.

The above prepared transparencies were incorporated into a Xerox Corporation 5760 digital color copier containing low melt polyester dry toners, and images were obtained with optical density values of 1.20 (cyan), 1.15 (magenta), 0.77 (yellow), and which images were waterfast when washed with water for 2 minutes at 50° C. and lightfast for a period of three months without any change in their optical density.

EXAMPLE III

Twenty transparency sheets were prepared by the solvent extrusion process (single side each time initially) on a Faustel Coater using a one slot die by providing for each a MYLAR™ base sheet (roll form) with a thickness of 100 microns, and coating the front side of the base sheet with a hydrophobic heat dissipating/fire resistant coating blend comprised of 75 parts by weight of polycarbonate, #035, having a melting point of 257° C. and available from Scientific Polymer Products, and 25 parts by weight of the fire retardant material bromo chloro paraffin, available as DD-8207, from Dover Corporation, which blend was present in a concentration of 5 percent by weight in dichloromethane. Subsequent to air drying at 100° C. and monitoring the difference in weight prior to and subsequent to coating, the dried MYLAR™ base sheet rolls contained 1.0 gram in a thickness of 10 microns of the above hydrophobic heat and fire resistant coating. This hydrophobic heat dissipating/fire resistant coating was further overcoated on a Faustel Coater using a one slot die with a hydrophobic ink receiving layer comprised of a blend of 50 parts by weight of hydroxypropylmethyl cellulose phthalate HPMCP available from Shin-Etsu Chemical, 20 parts by weight of decafluorobenzhydrol (Aldrich #19,658-4), 24.9 parts by weight of a dye mordant tetrahexadecyl ammonium bromide (Fluka 87298), 3.0 parts by weight of poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 2.0 parts by weight of didodecyl 3,3'thiodipropionate, and 0.1 microns part by weight colloidal silica available as Syloid 74 from W. R. Grace and Company, which blend was present in a concentration of 10 percent by weight in tetrahydrofuran. Subsequent to air drying at 100° C. and monitoring the difference in weight prior to and subsequent to coating, the dried MYLAR™ base sheet rolls contained 1.0 gram in a thickness of 10 microns of the ink receiving layer. Rewinding the coated side of the MYLAR™ base sheet (roll form) on to an empty core and using these rolls, the uncoated back side of the MYLAR™ base sheet was coated first with the above hydrophobic heat dissipating/fire resistant coating blend that was present on the front side with a Faustel Coater using a one slot die which was further overcoated on a Faustel Coater using a one slot die with the above hydrophobic ink receiving layer as that on the front side. The transparency sheets thus prepared had a haze value of 4.

The above prepared transparencies were printed with a Xerox Corporation accoustic ink jet test fixture equipped with a plurality of heaters with temperatures ranging from 50° C. to 200° C. for each heater and containing inks of the following compositions.

Cyan:

5 parts by weight of Orasol Blue 2GLN obtained from Ciba Geigy, 70 parts by weight of 2,2,3,3,4,4,5,5-octafluoro-1,6-hexanediol (Aldrich #40,642-2), and 25 parts by weight of 2,2,3,3,4,4,5,5-octafluoro-1-pentanol (Aldrich #26,943-3).

Magenta:

5 parts by weight of Orasol Red G obtained from Ciba Geigy, 70 parts by weight of 2,2,3,3,4,4,5,5-octafluoro-1,6-hexanediol (Aldrich #40,642-2), and 25 parts by weight of 2,2,3,3,4,4,5,5-octafluoro-1-pentanol (Aldrich#26,943-3).

Yellow:

5 parts by weight of Orasol Yellow 2GLN obtained from Ciba Geigy, 70 parts by weight of 2,2,3,3,4,4,5,5-octafluoro-1,6-hexanediol, (Aldrich #40,642-2), and 25 parts by weight of 2,2,3,3,4,4,5,5-octafluoro-1-pentanol (Aldrich #26,943-3).

Images were obtained that dried at 150° C. in less than a minute and had optical density values of 1.10 (cyan), 1.05 (magenta), 0.78 (yellow) with a projection efficiency of 91 percent. These images were waterfast when washed with water for 2 minutes at 50° C. and lightfast for a period of three months without any change in their optical density.

In embodiments, the preferred components of the transparency with a first layer coating, in a thickness of 10 microns, are 75 parts by weight of the polycarbonate, #035 available from Scientific Polymer Products, and 25 parts by weight of a heat dissipating and fire retardant compound ethylene bis-tetrabromo phthalimide, available as Saytex BT-93 from Ethyl Corporation, and a second 10 micron thick ink receiving layer comprised of a binder hydroxypropyl cellulose, (Klucel Type E available from Hercules Chemical Company) present in amounts of 40 parts by weight, the ink spreading agent hepta deca fluoro nonanoic acid (Aldrich #39,445-9) present in an amount of 25 parts by weight, the cationic dye complexing component, polymethyl acrylate trimethyl ammonium chloride, HX42-1available from Interpolymer Corporation, present in an amount of 25 parts by weight, the lightfastness UV compound poly[N,N-bis(2,2,6,6-tetramethyl-4-piperidinyl)-1,6-hexanediamine-co-2,4-dichloro-6-morpholino-1,3,5-triazine] (Cyasorb UV-3346, #41,324-0, available from Aldrich Chemical Company) present in amounts of 3 parts by weight, the lightfastness antioxidant compound didodecyl 3,3'-thiodipropionate, available as Cyanox LTDP, #D12,840-6, from Aldrich Chemical Company present in amounts of 1 part by weight, the lightfastness antiozonant compound N,N'-bis(1,4-dimethyl pentyl)-ρ-phenylene diamine, available as Santoflex 13 from Monsanto Chemicals, present in amounts of 1 part by weight, the filler colloidal silica present in amounts of 0.5 part by weight, and the biocide poly (oxyethylene (dimethylamino)-ethylene (dimethylamino) ethylene dichloride) (Busan 77 available from Buckman Laboratories Inc.) present in amounts of 4.5 parts by weight, and wherein these transparencies possessed a haze value of 3, a lightfastness value of 95 percent, and waterfastness value of 80 percent.

Other embodiments and modifications of the present invention may occur to those skilled in the art subsequent to a review of the information presented herein; these embodiments and modifications, as well as equivalents thereof, are also included within the scope of this invention.

What is claimed is:

1. A transparency comprised of a supporting substrate, and thereover two coatings, a first heat dissipating and fire resistant coating layer in contact with the substrate, and wherein said first coating is comprised of a binder with a melting point in the range of from about 100 to about 275° C. and a heat dissipating fire retardant component; and a second ink receiving coating layer thereover comprising a blend of a binder polymer, a cationic component, a lightfastness inducing agent, a filler, a biocide, and an ink spreading fluoro compound containing from 1 to about 25 fluorine atoms and having a melting point of between about 50 to about 100° C.

2. A transparency comprised of a supporting substrate, thereover and thereunder a first coating layer which dissipates heat and is substantially fire resistant, and which first coating is comprised of a binder with a melting point in the range of from about 100 to about 275° C. and a heat dissipating fire retardant component, and wherein said binder is present in amounts of from about 5 parts by weight to about 95 parts by weight and said fire retardant component is present in amounts of from about 95 parts by weight to about 5 parts by weight; and a second ink receiving coating layer situated on each of said first heat dissipating and fire resistant layers, and which second coating is comprised of a blend of a binder polymer, an ink spreading fluoro compound, a cationic component, a lightfastness inducing agent, a filler and a biocide, and which transparency possesses a haze value of from about 0.5 to about 5, a projection efficiency of between about 90 to about 95 percent, and a lightfastness value of between about 90 to about 98 percent.

3. A transparency comprised of a supporting substrate, and thereover and thereunder two coatings, a first heat dissipating and fire resistant coating layer in contact with the substrate, and wherein said first coating is comprised of a binder with a melting point in the range of from about 100° C. to about 275° C. and a heat dissipating fire retardant component; and in contact with each of said first layers a second ink receiving coating layer thereover comprising a blend of a binder polymer, a cationic component capable of complexing with ink composition dyes, a lightfastness inducing agent, a filler, a biocide, and an ink spreading fluoro compound containing from 1 to about 25 fluorines and wherein said fluoro compound possesses a melting point of between about 50° C. and about 100° C.

4. A transparency in accordance with claim 3 wherein the binder of the first heat dissipating and fire resistant layer is formed from a component selected from the group consisting of vinyl alcohol-vinyl acetate copolymers, vinyl chloride-vinyl acetate-vinyl alcohol terpolymers, vinyl chloride-vinylidene chloride copolymers, cellulose acetate hydrogen phthalate, hydroxypropylmethyl cellulose phthalate, hydroxypropylmethyl cellulose succinate, cellulose triacetate, cellulose acetate butyrate, styrene-allyl alcohol copolymers, poly(methylmethacrylate), poly(phenyl methacrylate), polycarbonate, a polyester latex, and a butadiene-acrylonitrile-styrene terpolymer latex.

5. A transparency in accordance with claim 3 wherein the coatings are contained thereover and thereunder said substrate and the binder polymer of the first heat dissipating and fire resistant layer is formed from a component selected from the group consisting of polyethylene carbonate, a polyethylene terephthalate latex, and vinyl chloride-vinyl acetate-vinyl alcohol terpolymers, and wherein said polymer is present in amounts of from about 50 to about 95 parts by weight.

6. A transparency in accordance with claim 3 wherein said heat dissipating fire retardant component is selected from the group consisting of (A) halogenated polystyrene, polyacrylate, halogenated polyesters, halogenated polyureas, halogenated epoxy resin, brominated paraffin, bromo chloro paraffin, bromo chloro paraffin with phosphorus, chloroparaffin, bromoacenaphthylene, dibromoethyl dibromo cyclohexane, dibromo neopentyl glycol, 2,4,6-tribromophenol, tetrabromo bisphenol A, tetrabromo bisphenol A di-2 hydroxyethyl ether, tetrabromo bisphenol A diacrylate, tetrabromo xylene, pentabromo toluene, bisethane, bisethane, pentabromo diphenyloxide, pentabromo diphenyloxide/aromatic phosphate, octabromo diphenyloxide, decabromo diphenyloxide, hexabromo cyclododecane, tetradecabromo diphenoxy benzene, hexabromo cyclododecane tribromoallyl other, ethylene bis-tetrabromo phthalimide, ethylenebisdibromonorbornanedicarboximide, 1,2,3,4,7,8,9,10,13,13,14,14-dodeca chloro-1,4:7,10-dimethanodibenzo (a,e) cyclooctene, pentabromo chloro cyclohexane; (B) ammonium phosphate, dimelamine phosphate, melamine phosphate, ammonium polyphosphate, tributyl phosphate, tricresyl phosphate, triphenyl phosphate, trixylenyl phosphate, trichloroethyl phosphate, tributoxyethyl phosphate, diphenyl cresyl phosphate, diphenyl octyl phosphate, alkyl/diaryl phosphate blend, propylated triaryl phosphate, brominated triaryl phosphate, fatty alcohol polyglycol phosphate, tetrakis(2-chloroethyl) ethylene phosphate; (C) magnesium carbonate, magnesium hydroxide, antimony oxide, zinc borate, alumina trihydrate, semicalcined silica-alumina, silicone fluid, and mixtures thereof.

7. A transparency in accordance with claim 3 wherein the heat dissipating fire retardant component of the first layer is selected from the group consisting of poly[pentabromo benzyl]acrylate, bromo paraffin, chloro paraffin, ethylene bis-tetrabromo phthalimide, alumina trihydrate, and zinc borate, and which component is-present in amounts of from about 50 to about 5 parts by weight.

8. A transparency in accordance with claim 3 wherein the thickness of the first heat dissipating and fire resistant coating layer in contact with the substrate is from about 0.1 microns to about 25 microns.

9. A transparency in accordance with claim 3 wherein the binders for the second ink receiving layer situated on the top of the first heat dissipating and fire resistant layer is formed from hydrophilic polymers selected from the group consisting of polysaccharides, vinyl polymers, acrylic latex polymers, poly(ethylene oxide), epichlorohydrin-ethylene oxide copolymer, and mixtures thereof.

10. A transparency in accordance with claim 3 wherein the second ink receiving binder layer situated on the top of the first heat dissipating and fire resistant layer is selected from the group consisting of polysaccharides, vinyl polymers, and polyethylene oxide, and which component is present in amounts of from about 10 to about 40 parts by weight.

11. A transparency in accordance with claim 3 wherein the ink spreading fluoro compound of the ink receiving layer is selected from the group consisting of perfluoroadipic acid hydrate, nonadeca fluorodecanoic acid, 1,1,1,2,2,3,3,4,4,5,5,6,6,7,7,8,8-heptadecafluoro-10-iododecane, heptadeca fluorononanoic acid, bis(trifluoromethyl) 2,3,4,5,6-pentafluorobenzamide, decafluorobenzhydrol, decafluorobenzo phenone, decafluorobiphenyl, 2,2',3,3',5,5',6,6'-octafluorobiphenyl, 2,2,3,3,4,4,5,5-octafluoro-1,6-hexanediol, octafluoronaphthalene, 4,4'-dimethoxy octafluorobiphenyl, α,α,α,2,3,5,6-heptafluoro-ρ-tolylhydrazine, 2,5-bis(trifluoromethyl)benzoic acid, 3,5-bis (trifluoromethyl)pyrazole, 2,8-bis(trifluoromethyl)-4-quinolinecarbonitrile, hexafluoro glutaric acid, 3,3' (hexafluoro isopropylidene)dianiline, 4,4'-(hexafluoroisopropylidene) ditoluene, 3,5-bis (trifluoromethyl)benzylalcohol, 4-bromo-2,8-bis (trifluoromethyl) quinoline, 2,3,4,5,6-pentafluorobenzhydrol, 2,3,4,5,6-pentafluoro-α(nitro methyl)-benzylalcohol, pentafluorophenylhydrazine, 2,3,4,5-tetrafluoro benzoic acid, 1-(2,3,5,6-tetrafluorophenyl) imidazole, 2,3,5,6-tetrafluoro phenyl hydrazine, tetrafluoro phthalonitrile, 2,3,5,6-tetrafluoro-4-pyridine carbonitrile, tetrafluororesorcinol hydrate, 1-bromo4-chloro-2,3,5,6-tetrafluorobenzene, 1,4-dibromotetrafluoro benzene, 4-bromo-2,3,5,6-tetrafluoroaniline, 4-amino-2,3,5,6-tetrafluoropyridine, 2,2,2-trifluoro acetamide, 2,4,5-trifluoro aniline, 2-(trifluoromethyl) benzophenone, 4,4,4-trifluoro-1-(2-naphthyl)-1,3-butanedione, 2-chloro-5-(trifluoromethyl) benzoic acid, 4-chloro-7-(trifluoromethyl)quinoline, 4-chloro-8-(trifluoro methyl)quinoline, ethyl-2-{4-[trifluoromethyl phenoxy] phenoxy} propionate, β-nitro-4-(trifluoromethoxy)styrene, trans-β-nitro-2-(trifluoromethyl) styrene, trans-β-nitro-3-(trifluoromethyl)styrene 4-nitro-3-(trifluoromethyl)phenol, 2-chloro-3,5-dinitro benzotrifluoride, 4-chloro-3,5-dinitrobenzotrifluoride, 2-amino-3-chloro-5-(trifluoromethyl) pyridine, 2,2,2-trifluoro-2',4,'6'-trimethoxyacetophenone, 2,3,4-trifluoro-6-nitroaniline, 3,3,3-trifluoro-1-phenyl-1,2-propanedione hydrate, 3,3'difluorobenzophenone, 4,4'-difluorobiphenyl, 3,5-difluoro phenylacetic acid, 2,5-difluorophenylhydrazine, 2-chloro-2,2-difluoroacetamide, 3-chloro-2,4-difluoroaniline, 2-chloro-3,5-difluoroanisole, 2'-fluoroacetanalide, 3'-fluoroacetanalide, 2-fluorobiphenyl, 3-fluorocatechol, 5'-fluoro-2'-hydroxyacetophenone, 4-fluorophenyl methyl sulfone, 4-bromo-2-fluoro-6-nitroanisole, 2-chloro-4-fluorobenzaldehyde, 2-chloro-4-fluoro benzonitrile, 2-chloro-6-fluorobenzonitrile, 3-chloro-4-fluorobenzonitrile, 2-chloro-4-fluoro-5-methylaniline, 2,4-dibromo-6-fluoroaniline, 2,6-dibromo-4-fluoroaniline, 2,6-dibromo -4-fluorophenol, heptadeca fluorononanoic acid, perfluoroadipic acid hydrate, 2,5-bis(trifluoro methyl) benzoic acid, 4,4'difluorobiphenyl, and 3,5-difluoro phenylacetic acid.

12. A transparency in accordance with claim 3 wherein the second ink receiving layer situated on the top of the first heat dissipating and fire retardant layer is formed from a cationic dye complexing compound selected from the group consisting of tetra ammonium fluoride hydrate, 2,2,2-trifluoroethylamine hydro chloride, 2-fluoro-1-methylpyridinium-ρ-toluenesulfonate, 1-fluoro pyridinium trifluoromethane sulfonate, 3,5-dichloro-1-fluoropyridinium triflate, hydroxypropyl trimethyl ammonium chloride hydroxyethyl cellulose, quaternary acrylic copolymer latexes, tetrahexadecyl ammonium bromide, tetraoctadecyl ammonium bromide, myristyl trimethyl ammonium bromide, didecyl dimethyl ammonium bromide, N-cetyl, N-ethyl morpholinium ethosulfate, tetra phenyl phosphonium chloride, hexadecyl tributyl phosphonium bromide stearyl tributyl phosphonium bromide, and mixtures thereof.

13. A transparency in accordance with claim 3 wherein the lightfastness inducing agent is comprised of a mixture of UV absorbing component, an antioxidant, and an antiozonant.

14. A transparency in accordance with claim 3 wherein the lightfastness inducing agent is selected from the group consisting of octyl dimethyl amino benzoate, octyl salicylate, octyl methoxy cinnamate, 2-hydroxy-4-(octyloxy)benzophenone, 2-hydroxy-4-dodecyloxy benzophenone, bis[2-hydroxy-5-tert-octyl-3-(benzotriazol-2-yl) phenyl methane, 2-(4-benzoyl-3-hydroxyphenoxy) ethylacrylate, poly[2-(4-benzoyl-3-hydroxyphenoxy) ethylacrylate], [2,2,6,6-tetramethyl-4-piperidinylβ,β,β',β'-tetramethyl-3,9-(2,4,8,10-tetraoxospiro (5,5) undecane) diethyl]-1,2,3,4-butanetetracarboxylate, [1,2,2,6,6-pentamethyl-4-piperidinyl/β,β,β',β'-tetramethyl-3,9-(2,4,8,10-tetraoxospiro (5,5) undecane)diethyl]-1,2,3,4-butane tetracarboxylate, 2-dodecyl-N-(2,2,6,6-tetramethyl-4-piperidinyl) succinimide, 2-dodecyl-N-(1,2,2,6,6-pentamethyl-4-piperidinyl) succinimide, N-(1-acetyl-2,2,6,6-tetramethyl-4-piperidinyl)-2-dodecyl succinimide, tetrasodium N-(1,2-dicarboxyethyl)-N-octadecyl sulfosuccinamate, poly[N,N-bis(2,2,6,6-tetramethyl-4-piperidinyl)-1,6-hexanediamine-co-2,4-dichloro-6-morpholino-1,3,5-triazine], didodecyl 3,3'-thiodipropionate, dioctadecyl 3,3'-thiodipropionate, 1,6-hexamethylene bis(3,5-di-tert-butyl-4-hydroxy hydrocinnamate), tetrakis [methylene(3,5-di-tert-butyl-4-hydroxy hydrocinnamate)], 2,2'-ethylidene bis(4,6-di-tert-butylphenyl) fluorophosphonite, 2,2,4-trimethyl-1,2-hydroquinoline, N,N'-bis(1,4-dimethyl pentyl)-ρ-phenylene diamine, 2,4,6-tris-(N-1,4-dimethyl pentyl-ρ-phenylene diamino)-1,3,5-triazine, and mixtures thereof, and which agent is present in amounts of from about 15 parts by weight to about 2 parts by weight.

15. A transparency in accordance with claim 3 wherein the lightfastness inducing agent is selected from the group consisting of octyl dimethyl amino benzoate, 2,2'-dihydroxy-4,4'-dimethoxy benzophenone, poly[N,N-bis(2,2,6,6-tetramethyl-4-piperidinyl)-1,6-hexanediamine-co-2,4-dichloro-6-morpholino-1,3,5-triazine], didodecyl 3,3'-thiodipropionate, and N,N'-bis(1,4-dimethyl pentyl)-ρ-phenylene diamine.

16. A transparency in accordance with claim 3 wherein the filler of the ink receiving layer is selected from the group consisting of sodium borosilicate glass hollow microspheres, hollow microspheres of phenolic polymers, vinylidene chloride-acrylonitrile hollow microspheres, sodium metasilicate pentahydrate, magnesium oxide, zirconium oxide, colloidal silica, titanium dioxide, calcium carbonate, zinc oxide, barium titanate, antimony oxide, and mixtures thereof, and which filler is present in amounts of from about 0.1 microns part by weight to about 50 parts by weight.

17. A transparency in accordance with claim 3 wherein the thickness of the second ink receiving coating layer in contact with the first heat and fire resistant layer is from about 0.1 microns to about 25 microns.

18. A transparency in accordance with claim 3 wherein the haze value is from about 0.5 to about 5.

19. A transparency in accordance with claim 3 wherein the lightfastness value is from about 80 to about 98 percent.

20. A transparency in accordance with claim 3 wherein the substrate is selected from the group consisting of (1) polyethylene terephthalate, (2) polyethylene naphthalates, (3) polycarbonates, (4) polysulfones, (5) polyether sulfones, (6) poly(arylene sulfones), (7) cellulose triacetate, (8) polyvinyl chloride, (9) cellophane, (10) polyvinyl fluoride, (11) polypropylene, and (12) polyimides.

21. A transparency in accordance with claim 3 wherein said melting point is from about 150° C. to about 260° C., and which transparency possesses a haze value of from about 0.5 to about 10 and a lightfastness value of from about 95 to about 98.

22. A transparency in accordance with claim 3 wherein the first heat and fire resistant coating binder is a polymer formed from a polycarbonate, a polyester, or a vinyl chloride-vinylidene chloride copolymer, said heat and fire retardant component is formed from ethylene bis-tetrabromo phthalimide, bromo chloro paraffin, or poly[penta bromobenzyl]acrylate; said second ink receiving layer polymer is formed from polyvinyl alcohol, or hydroxypropylmethylcellulose; said fluoro component is formed from heptadecafluorononanoic acid, perfluoroadipic acid hydrate, 2,5-bis(trifluoro methyl) benzoic acid, 4,4'-difluorobiphenyl, or 3,5-difluoro phenylacetic acid; said cationic component is formed from a monomer or polymer capable of complexing with a dye of an ink composition, which cationic component is formed from quaternary acrylic copolymer latexes, tetrahexadecyl ammonium bromide, hexadecyl tributyl phosphonium bromide, or stearyl tributyl phosphonium bromide; the lightfastness inducing agent of the ink receiving layer is formed from octyl dimethyl amino benzoate, 2,2'-dihydroxy-4,4'-dimethoxy benzophenone, or poly[N,N-bis (2,2,6,6-tetramethyl-4-piperidinyl)-1,6-hexanediamine-co-2,4-dichloro-6-morpholino-1,3,5-triazine); the biocide of the ink receiving layer is formed from cationic poly (oxyethylene (dimethylamino)-ethylene (dimethylamino) ethylene dichloride), or anionic potassium N-hydroxymethyl-N-methyl-dithiocarbamate; the filler of the ink receiving layer is formed from colloidal silica, hollow composite microspheres of a polyvinylidene chloride-acrylonitrile copolymer, or microspheres of phenolic polymers; and which transparency possesses a haze value of from about 0.5 to about 10 and a lightfastness value of from about 95 to about 98.

23. A transparency in accordance with claim 22 wherein the heat dissipating and fire resistant coating layer is of a thickness of from about 1 to about 10 microns, the binder is polycarbonate present in an amount of 75 parts by weight, the heat dissipating and fire retardant compound is ethylene bis-tetrabromo phthalimide present in an amount of 25 parts by weight; and the second ink receiving layer is from about 5 to about 15 microns in thickness, the binder is hydroxypropyl cellulose present in an amount of 40 parts by weight, the ink spreading agent is heptadeca fluoro nonanoic acid present in an amount of 25 parts by weight, the cationic component is polymethyl acrylate trimethyl ammonium chloride present in an amount of 25 parts by weight, the lightfastness agent contains the UV compound poly[N,N-bis(2,2,6,6-tetramethyl-4-piperidinyl)1,6-hexanediamine-co-2,4-dichloro-6-morpholino-1,3,5-triazinel] present in amounts of 3 parts by weight, the lightfastness agent contains the antioxidant compound didodecyl 3,3'-thiodipropionate present in amounts of 1 part by weight, the lightfastness agent contains the antiozonant compound N,N'-bis (1,4-dimethyl pentyl)-ρ-phenylene diamine present in an amount of 1 part by weight, the filler is colloidal silica present in an amount of 0.5 part by weight, and the biocide is poly(oxyethylene (dimethylamino)-ethylene (dimethylamino) ethylene dichloride) present in an amount of 4.5 parts by weight; and which transparency has a haze value of 3, a lightfastness value of 95 percent, and waterfastness value of 80 percent.

* * * * *